United States Patent [19]

Flensburg et al.

[11] Patent Number: 4,579,620

[45] Date of Patent: Apr. 1, 1986

[54] APPARATUS FOR PASTING INSERTS INTO PUBLICATIONS

[76] Inventors: Carl G. A. Flensburg, Grevegatan 31, Malmö , Sweden, S-216 17; Rolf H. V. Isaksson, Diakongatan 59, Malmö , Sweden, S-216 23

[21] Appl. No.: 589,078

[22] PCT Filed: Jun. 6, 1983

[86] PCT No.: PCT/SE83/00228

§ 371 Date: Feb. 3, 1984

§ 102(e) Date: Feb. 3, 1984

[87] PCT Pub. No.: WO83/04221

PCT Pub. Date: Dec. 8, 1983

[30] Foreign Application Priority Data

Jun. 4, 1982 [SE] Sweden ..... 8203443

[51] Int. Cl.[4] ..... B65C 9/10; B65C 9/14

[52] U.S. Cl. ..... 156/497; 156/568; 156/571; 156/DIG. 29; 156/DIG. 31

[58] Field of Search ..... 156/568, 571, DIG. 31, 156/578, DIG. 29, DIG. 30, DIG. 32, 497

[56] References Cited

U.S. PATENT DOCUMENTS 1,158,787 11/1915 Coates ..... 156/568

3,798,109 3/1974 Gamroth ..... 156/DIG. 31

4,021,293 5/1977 Total ..... 156/568

FOREIGN PATENT DOCUMENTS 1949769 4/1970 Fed. Rep. of Germany .

2049850 10/1970 Fed. Rep. of Germany .

2118742 11/1971 Fed. Rep. of Germany .

*Primary Examiner*—Michael Wityshyn

*Attorney, Agent, or Firm*—Merchant, Gould, Smith, Edell, Welter & Schmidt

[57] ABSTRACT

Apparatus for pasting inserts (13) into publications (11) which are advanced by means of a conveyor (10) for publications in a straddling position. The apparatus comprises a magazine (12) for the inserts, a picker (14) for pulling the inserts one at a time from the magazine, and transfer means (15) for transporting an insert which has been pulled out, to a publication on the conveyor. This transfer means comprises a transfer member which can be driven continuously in a path about a substantially vertical axis (44) and which is arranged to pass at the movement thereof tangentially past the picker and the conveyor, respectively, at diametrically opposite sides of the axis. The suction nozzles are controlled to remove an insert from the picker and deliver said insert to a publication on the conveyor.

3 Claims, 5 Drawing Figures

APPARATUS FOR PASTING INSERTS INTO PUBLICATIONS

The invention relates to an apparatus for pasting inserts into publications which are being advanced by means of a conveyor for publications in a straddling position, comprising a magazine for the inserts, a picker for pulling out the inserts one at a time from the magazine, and transfer means for transporting an insert which has been pulled out, from the picker to a publication on the conveyor.

The inserts which are referred to may comprise cards of different kinds, samples, sample bags, order forms or other flat pieces which are well suited to be attached to a sheet inside a publication or to the outside of the cover of the publication.

There are already several different apparatuses of the kind referred to herein, but a drawback of these apparatuses is that they are relatively bulky such that they cannot be associated with a row of feeders which are distributed along the conveyor, without removing one of the feeders. The object of the invention is to provide such a design of the apparatus that it can be located adjacent a row of feeders to operate between two adjacent feeders, without the necessity of removing any feeder and without interfering with the control of the production or the availability of the feeders or the conveyor. It is also intended to provide an apparatus which is of a reliable and relatively simple construction and which moreover without any difficulty can be made mobile along the row of feeders to be placed at any desired location.

In order to attain this object the apparatus of the kind referred to above has obtained the characteristics appearing from claim 1.

Figure 1:
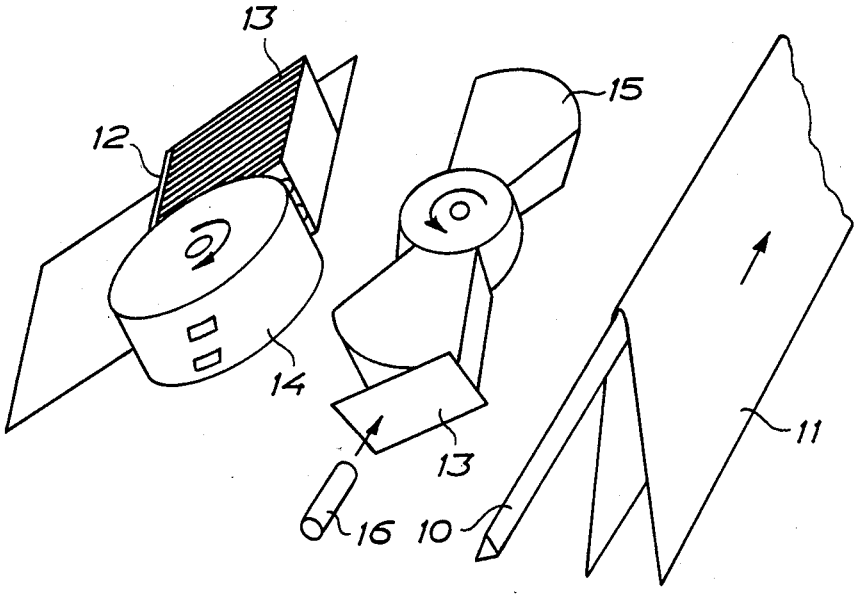
Figure 2:
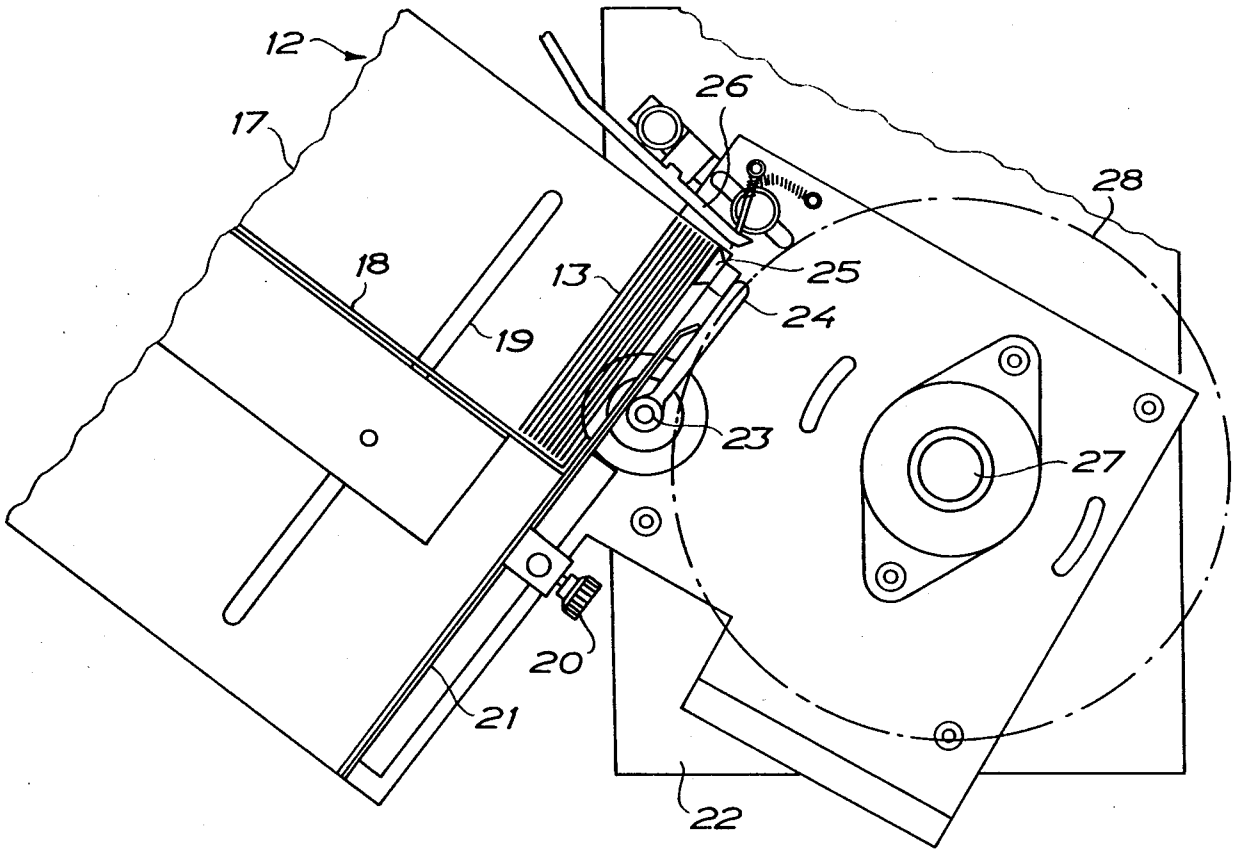
Figure 3:
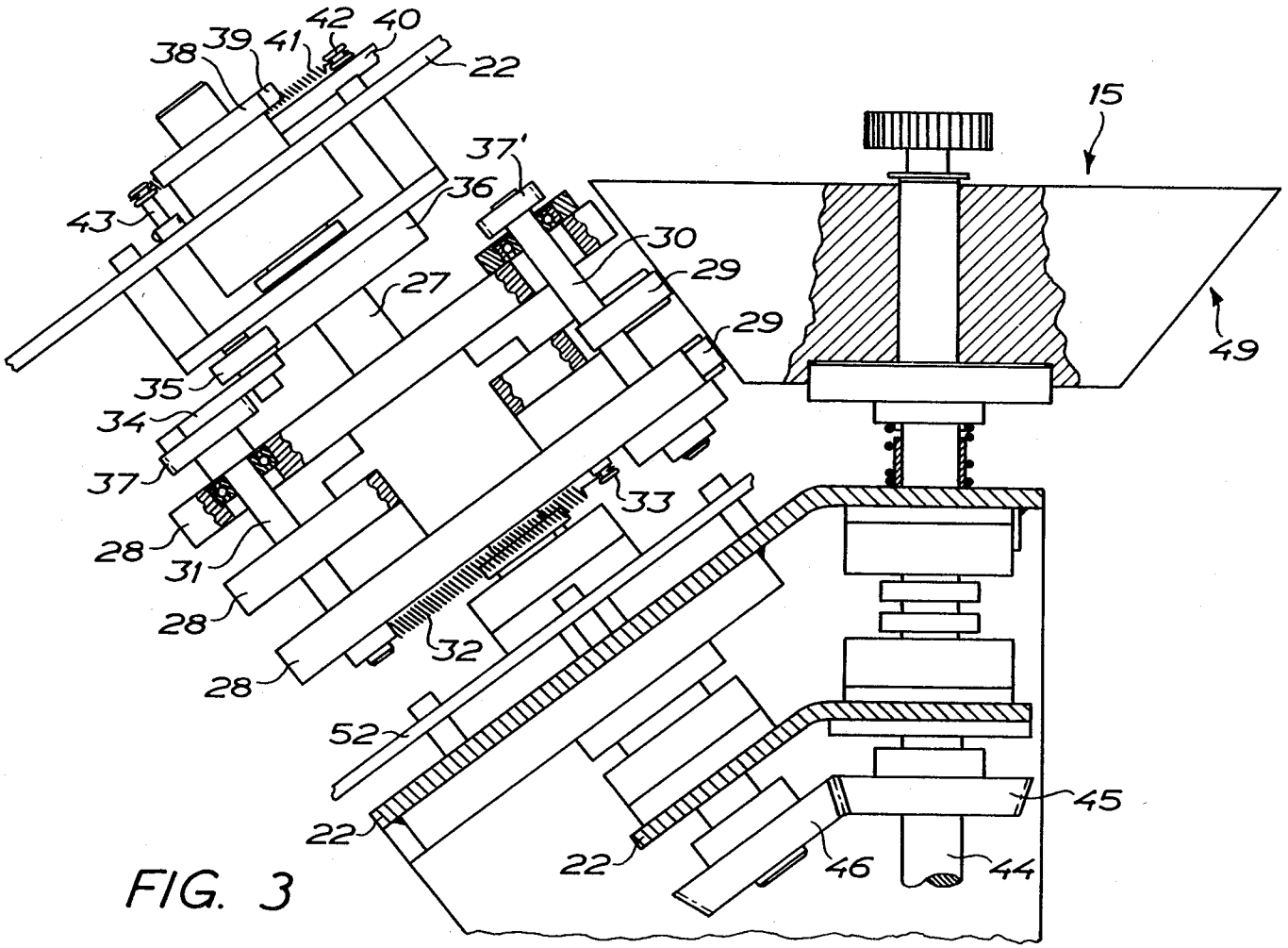
Figure 4:
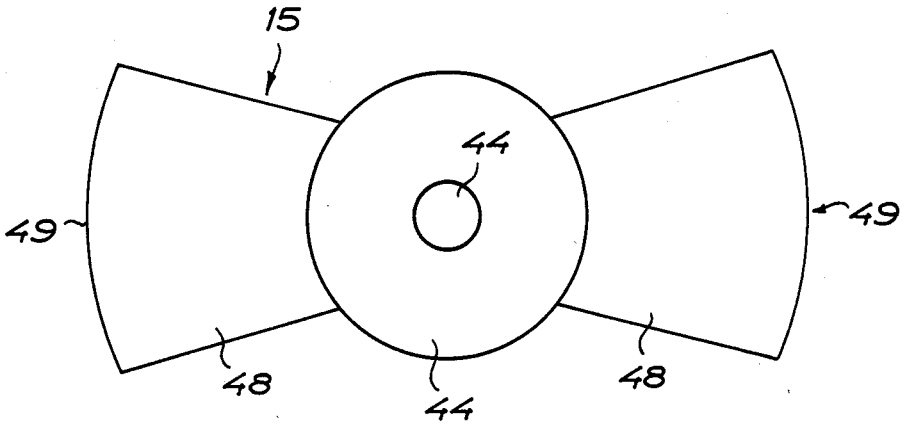
Figure 5:
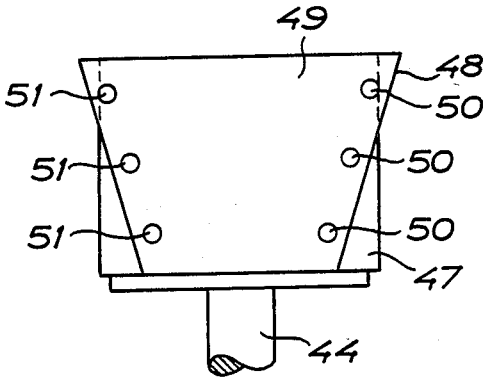

In order to explain the invention in more detail an embodiment thereof will be described with reference to the accompanying drawings in which FIG. 1 is a diagrammatic perspective view illustrating the embodiment of the pasting apparatus according to the invention as regards the principle, FIG. 2 is a plan view of the magazine, FIG. 3 is a side view, partly a vertical cross-sectional view, of the picker and the transfer member, FIG. 4 is a plan view of the transfer member, and FIG. 5 is an end view of the transfer member.

According to the diagrammatic FIG. 1, relating to the principle of the invention, the pasting apparatus of the invention shall be associated with a conveyor 10 for transporting publications or signatures 11 in a straddling position. Such conveyors are well known in the art and comprise a saddle support and a chain moving along this support and having drives which advance the signatures along the support mutually spaced. The pasting apparatus is arranged substantially perpendicularly to the conveyor 10 and comprises a magazine 12 for the inserts to be pasted into the publications or signatures 11. As mentioned above, these inserts may comprise cards or other flat pieces; in FIG. 1 a stack of cards 13 is shown in the magazine. A rotating picker 14 is associated with the magazine and collects one card at a time from the magazine and pulls said card therefrom in order that the card shall then be taken over by a transfer member 15. This transfer member takes the card away from the picker 14 and transfers the card to the publication or signature 11, a glue applicator 16 being arranged adjacent the path of the moving card between the picker and the publication or signature. The glue applicator provides the card with glue at the side thereof to be applied against the publication or signature.

Referring to FIG. 2, the magazine 12 comprises a bottom plate 17 on which there is provided a support 18 projecting upwards perpendicularly from the bottom plate. This support is displaceable along a slot 19 in the bottom plate and can be locked in a desired displaced position by means of a screw device 20 so that the position of the support on the bottom plate can be adapted to the size of the inserts to be received by the magazine. Generally, these inserts must be relatively flat to be attached to a publication. The inserts are arranged in a stack extending substantially perpendicularly to the support 18 as indicated in FIG. 2. The bottom plate 17 slopes downwards towards a support rail 21 for the front insert of the stack. In the frame of the pasting apparatus, partly indicated at 22, a shaft 23 is rotatably mounted, which has one or more arms, one arm thereof being shown at 24, with a suction cup 25. The shaft 23 can be rotated back and forth over a limited angle by means of a device to be described later, in order to engage the suction cup or the suction cups 25 with the front insert in the magazine and pull out this insert at the free edge thereof, i.e. at the edge opposite to the support 18, past a resiliently yieldable holding back member 26 engaging said edge. The member 26 is pivoted to the frame 22 and preferably is adjustable to different positions so as to be adapted to the inserts of interest for the time being.

A picker is provided to pull out completely the insert from the magazine, and this picker is shown in more detail in FIG. 3 to which reference is made. An inclined shaft 27 rotatably mounted in the frame 22 supports the picker which in this case comprises three circular discs 28 mutually spaced axially so as to leave room for two arms 24 with suction cups 25. On the central disc and the bottom disc a mechanical gripper 29 is arranged which is mounted to a shaft 30 rotatably mounted in the discs 28. Also the top disc can be provided in a corresponding manner with a gripper mounted to the same shaft 30, although this has not been shown here. Two shafts 30 are arranged with grippers such that the picker has two diametrically opposite grip positions to pull out two cards from the magazine at each revolution. A shaft 31 is rotatably mounted adjacent each shaft 30 and at the lower end thereof the shaft 30 is connected to a tension spring 32 which is connected to the bottom disc 28 at a pin 33, and at the upper end thereof has an arm 34 with a cam roller 35 in order to be engaged, under the bias of the spring 32, with a cam disc 36 stationarily arranged in the frame. The shaft 31 has a toothed segment 37 to engage a toothed wheel 37' on the shaft 30. In order to simplify the drawing there is shown in FIG. 3 the shaft 30 for one gripper position and the shaft 31 for the other diametrically opposite gripper position, but for each gripper position the toothed segment 37 on the shaft 31 engages the toothed wheel 37' on the adjacent shaft 30.

The shaft 27 has a cam disc 38 arranged for co-operation with a cam roller 39 mounted to an arm 40 which is fixedly connected to the shaft 23 for the arm or arms 24, mentioned with reference to FIG. 2, and said arm 40 is biased by means of a spring 41 to engage the cam roller 39 with the cam disc 38. The spring 41 has a connection 42 on the arm 40 for one end of the spring while a pin 43 on the frame 22 forms a connection for the other end of the spring.

A substantially vertical drive shaft 44 rotatably mounted in the frame 22 is provided with a conical toothed wheel 45 which drivingly engages a conical toothed wheel 46 on the shaft 27. The ratio of the toothed wheels 45 and 46 is 1:1 in order that the shaft 27 wi11 rotate synchronously with the shaft 44. The cam discs 36 and 38 are formed to co-ordinate the movements of the arm or arms 24 with the movement of the grippers 29 past the magazine 12 in such a way that the front insert 13 in the magazine will be pulled out at the free edge thereof to be held in such position that it can be gripped by means of the grippers 29 at the moment when these grippers pass the magazine. Also the vacuum in the suction cup or suction cups 25 is controlled in dependence on the rotation of the shaft 27 so that the insert will be released from the suction cup or suction cups at the proper moment to be taken over by the grippers 29.

The transfer member 15 is arranged on the shaft 44 to be rotated by means of this shaft. The transfer member forms a central hub 47 with two diametrically projecting wings 48, FIGS. 4 and 5, the end surfaces 49 of the wings form part of a truncated cone of declining diameter having a discontinuous outer periphery including two symmetric wings projecting radially from the vertical axis, the outer peripheral edges thereof forming a quadrilateral with two edges converging. Three suction conduits 50 open in the end surface at one edge of the wing, viz. the edge which is the leading edge as seen in the intended rotational direction of the transfer member, indicated in FIG. 1. In a corresponding manner, three blast conduits 51 open at the other edge. The cone angle of the end surfaces 49 is adapted to the inclination of the shaft 27 as will be seen from FIG. 3, and is defined principally by the top angle of the saddle 10, which defines the opening angle of the straddling publications or signatures 11. The transfer member is in such position that the end surfaces 49 at the rotation of the transfer member pass closely to the discs 28 and at a diametrically opposite position pass closely to the publications or signatures 11. The suction in the conduits 50 is controlled in dependence on the rotation of the shaft 44 in such a manner that the transfer member 15, when one of the end surfaces 49 thereof passes the discs 28, can attract by suction an insert held by one of the grippers 29, the control of the suction and the control of the movement of the grippers being co-ordinated and synchronized such that the grippers release the insert at the same time as the transfer member attracts said insert. The insert held by the transfer member 15 will be transported by the transfer member 15 along a semi circle to the publication or signature 11, as will be seen from FIG. 1. At one position in this transport path, the glue applicator 16 is arranged to spray glue from a hot melt aggregate either along a line or spotwise onto the side of the insert which faces outwardly and accordingly will face the publication or signature 11 when the insert is transported towards the publication or signature 11 by means of the transfer member 15. In this position, the suction in the conduits 15 is interrupted so that the insert will be released from the transfer member and will be thrown or pressed against the publication or signature. The insert can be pressed against the publication or signature by means of air thrust from the conduits 51 against the insert so that the insert will be pressed at the intended position to be more securely attached by means of the glue applied. On the frame 22 there can be arranged a stationary guide 52 which extends from the picker to the conveyor 10 to guide the inserts during the movement thereof from the picker to the publications or signatures, which may be necessary for large size inserts.

The control of suction and blasting has not been described in detail because it is well known in the art to provide such control by means of rotative slide valves or similar devices in order to achieve that the suction or blast is applied at the proper moment in the operation cycle. The control of the glue applicator can be performed by means of a photocell which is located in the path of the moving inserts when transported by means of the transfer member 15.

We claim:

1. Apparatus for pasting inserts (13) into publications (11) which are being advanced by means of a conveyor (10) for publications in a straddling position, comprising a magazine (12) for the inserts, a picker (14) for pulling out the inserts one at a time from the magazine, and transfer means (15) for transporting an insert which has been pulled out from the picker to a publication on the conveyor, characterized in that the transfer means (15) comprises a transfer member which can be continuously driven in a path about a substantially vertical axis and being formed in the shape of a truncated cone of declining diameter having a discontinuous outer periphery including two symmetric wings projecting radially from said vertical axis, the outer peripheral edges thereof forming a quadrilateral with two edges converging, and has circumferentially located suction nozzles (50) and is arranged to pass during the movement thereof tangentially past the picker and the conveyor, respectively, at diametrically opposite side of the axis, the suction nozzles being controlled to remove an insert from the picker and deliver the insert to a publication on the conveyor.

2. An apparatus according to claim 1 wherein said quadrilateral surface includes at least one suction aperture located adjacent one of said converging edges and at least one blast aperture located adjacent said other converging edge, means connected to said suction and blast apertures to attract and repel, respectively, inserts therefrom.

3. An apparatus according to claim 2 including means for alternatively activating said suction aperture to attract an insert and thereafter activating said blast aperture to apply said insert into the target publication.

* * * * *